US010380971B2

(12) United States Patent
Oh et al.

(10) Patent No.: US 10,380,971 B2
(45) Date of Patent: Aug. 13, 2019

(54) DISPLAY DEVICE

(71) Applicant: SILICON WORKS CO., LTD., Daejeon-si (KR)

(72) Inventors: Kwang Il Oh, Daejeon (KR); Jung Hwan Choi, Daejeon-si (KR); Yun Tack Han, Anyang-si (KR); Hyun Kyu Jeon, Daejeon (KR)

(73) Assignee: SILICON WORKS CO., LTD. (KR)

( * ) Notice: Subject to any disclaimer, the term of this patent is extended or adjusted under 35 U.S.C. 154(b) by 780 days.

(21) Appl. No.: 14/932,334

(22) Filed: Nov. 4, 2015

(65) Prior Publication Data

US 2016/0125840 A1 May 5, 2016

(30) Foreign Application Priority Data

Nov. 5, 2014 (KR) ..... 10-2014-0153090

(51) Int. Cl.

*G09G 5/00* (2006.01)
*G09G 3/20* (2006.01)
*G09G 3/32* (2016.01)

(52) U.S. Cl.

CPC ..... *G09G 5/008* (2013.01); *G09G 5/006* (2013.01); *G09G 3/2096* (2013.01); *G09G 3/32* (2013.01); *G09G 2320/0295* (2013.01); *G09G 2370/08* (2013.01)

(58) Field of Classification Search

CPC ..... G09G 5/008; G09G 5/006; G09G 2320/0295; G09G 3/32; G09G 2370/08; G09G 3/2096

See application file for complete search history.

(56) References Cited

U.S. PATENT DOCUMENTS 5,727,191 A * 3/1998 Konishi ..... G09G 5/006 345/698
6,307,543 B1 * 10/2001 Martin ..... G09G 5/006 345/213
6,564,269 B1 * 5/2003 Martin ..... G09G 5/006 348/E7.026
6,914,597 B2 * 7/2005 Myers ..... G09G 5/006 326/36
8,606,946 B2 * 12/2013 Anderson ..... H04L 12/6418 709/230
8,630,318 B2 * 1/2014 Anderson ..... H04L 12/6418 370/519
8,645,566 B2 * 2/2014 Anderson ..... H04L 29/06027 709/236

(Continued)

FOREIGN PATENT DOCUMENTS

CN 103886833 6/2014
KR 10-2009-0131786 12/2009

(Continued)

*Primary Examiner* — Patrick N Edouard
*Assistant Examiner* — Joseph P Fox
(74) *Attorney, Agent, or Firm* — Polsinelli PC

(57) ABSTRACT

Disclosed is a display device. The display device may use one transmission line to perform bidirectional data transmission between a timing controller and a source driver. Furthermore, the display device may control the timing controller to transmit a Tx signal to the source driver and control the source driver to transmit correction data, through one transmission line.

16 Claims, 6 Drawing Sheets

(56) References Cited

U.S. PATENT DOCUMENTS 8,687,658 B2 * 4/2014 Anderson ..... H04L 29/06027 370/509
8,705,521 B2 * 4/2014 Anderson ..... H04L 29/06027 370/389
8,854,344 B2 * 10/2014 Glen ..... G09G 5/003 345/204
8,963,905 B2 * 2/2015 Cho ..... G09G 3/3685 341/126
9,203,606 B2 * 12/2015 Han ..... G09G 5/008
9,818,373 B2 * 11/2017 Ohta ..... G09G 3/3283
2002/0044147 A1 4/2002 Martin
2003/0033417 A1 * 2/2003 Zou ..... G06F 3/023 709/230
2003/0087671 A1 * 5/2003 Ruha ..... H04L 25/0264 455/557
2004/0080523 A1 * 4/2004 Myers ..... G09G 5/006 345/699
2004/0218624 A1 * 11/2004 Kobayashi ..... G06F 3/14 370/463
2008/0007181 A1 * 1/2008 Pickering ..... G09F 9/33 315/82
2008/0088648 A1 * 4/2008 Nathan ..... G09G 3/3233 345/690
2008/0116936 A1 * 5/2008 Huang ..... H03K 19/018528 326/83
2008/0291181 A1 * 11/2008 Nam ..... G09G 3/3611 345/204
2010/0149082 A1 * 6/2010 Hong ..... G09G 3/3611 345/88
2010/0225637 A1 * 9/2010 Jeon ..... G09G 3/20 345/213
2011/0018858 A1 * 1/2011 Ryu ..... G09G 3/3233 345/213
2011/0037758 A1 * 2/2011 Lim ..... H03L 7/0805 345/213
2011/0102418 A1 * 5/2011 Park ..... G09G 3/3233 345/214
2011/0122119 A1 * 5/2011 Bae ..... G09G 3/3233 345/211
2011/0181558 A1 * 7/2011 Jeon ..... G09G 3/3611 345/204
2011/0205250 A1 * 8/2011 Yoo ..... G09G 3/3233 345/690
2011/0210958 A1 * 9/2011 Yoo ..... G09G 3/325 345/214
2011/0216056 A1 * 9/2011 Yoo ..... G09G 3/32 345/212
2011/0234574 A1 * 9/2011 Tanaka ..... G09G 3/2096 345/211
2011/0242066 A1 * 10/2011 Jeon ..... G09G 3/20 345/204
2011/0254871 A1 * 10/2011 Yoo ..... G09G 3/3233 345/690
2013/0113777 A1 * 5/2013 Baek ..... G09G 3/20 345/212
2013/0223293 A1 * 8/2013 Jones ..... H04L 5/14 370/276
2014/0098893 A1 * 4/2014 Ju ..... H04N 19/127 375/240.26
2014/0176400 A1 * 6/2014 Park ..... G09G 3/3233 345/76
2014/0176401 A1 * 6/2014 Kim ..... G09G 3/3208 345/76
2014/0176524 A1 * 6/2014 Lee ..... G09G 3/3233 345/212
2014/0176625 A1 * 6/2014 Yoon ..... G09G 3/3233 345/691
2014/0347332 A1 * 11/2014 Lee ..... G09G 3/3233 345/204
2015/0123953 A1 * 5/2015 Shim ..... G09G 3/3233 345/205
2015/0161940 A1 * 6/2015 Woo ..... G09G 3/003 345/58
2015/0179105 A1 * 6/2015 Mizukoshi ..... G09G 3/3266 345/76
2015/0213757 A1 * 7/2015 Takahama ..... G09G 3/3266 345/691
2015/0279324 A1 * 10/2015 Ohta ..... G09G 3/3283 345/690
2015/0379669 A1 * 12/2015 Venkatesh ..... G06T 1/20 345/522
2015/0379909 A1 * 12/2015 Yu ..... G09G 3/006 345/690
2016/0012798 A1 * 1/2016 Oh ..... G09G 3/325 345/205
2016/0035280 A1 * 2/2016 Kim ..... G09G 3/3233 345/80
2016/0071445 A1 * 3/2016 Kim ..... G09G 3/006 345/212
2016/0078805 A1 * 3/2016 Woo ..... G09G 3/3225 345/78
2016/0098961 A1 * 4/2016 Han ..... G09G 3/3291 345/691
2016/0189621 A1 * 6/2016 Kim ..... G09G 3/3258 345/215
2018/0122294 A1 * 5/2018 Do ..... G09G 3/3225
2018/0144723 A1 * 5/2018 Lim ..... G09G 5/18

FOREIGN PATENT DOCUMENTS

KR 10-1388286 4/2014
KR 10-1463651 11/2014

* cited by examiner

DISPLAY DEVICE

BACKGROUND

1. Technical Field

The present disclosure relates to a display device, and more particularly, to a display device which is performing bidirectional data communication between a timing controller and a source driver.

2. Related Art

In general, a display device may include a display panel having a plurality of gate lines and a plurality of source lines, a gate driver for supplying a gate driving signal to the plurality of gate lines, a source driver for supplying a source driving signal to the plurality of source lines, and a timing controller for transmitting a data signal to the source driver.

In such a display device, the timing controller needs to transmit a data signal to the source driver at high speed.

For this operation, the display device may use various interfaces. For example, the timing controller provides a data signal in which a clock signal is embedded through CEDS (Clock Embedded Differential Signaling), to the source driver.

In the interface environment based on the CEDS, the source driver receives a transmit (Tx) signal transmitted from the timing controller through a transmission line, recovers a clock signal CLK and a data signal from the Tx signal, processes the data signal using the recovered clock signal, and outputs the processed signal as a source driving signal.

In the case of a display device using an organic light emitting diode (OLED), a source driver may include a plurality of sample and hold (S/H) circuits for sensing the changes in pixel information of a plurality of pixels included in a display panel.

The S/H circuit senses pixel information of an output channel of the source driver. The pixel information sensed through the S/H circuit is converted into correction data as a digital signal by an analog-digital converter (ADC), and then provided to a timing controller.

The timing controller may use the pixel information sensed through the S/H circuit, that is, the correction data in order to correct an image.

In the conventional display device, a plurality of source drivers share a pair of bus lines, and provide the correction data to the timing controller through the shared bus lines.

In the conventional display device, impedance mismatching easily occurs because the plurality of source drivers share the pair of bus lines. Furthermore, since one source driver exclusively occupies the pair of bus lines when transmitting pixel information, the plurality of source drivers need to sequentially transmit pixel information. As a result, precise timing alignment is required for each of the source drivers to secure a transmission period.

SUMMARY

Various embodiments are directed to a display device capable of performing bidirectional communication between a timing controller and a plurality of source drivers.

Also, various embodiments are directed to a display device capable of transmitting correction data corresponding to pixel information of a display panel using a transmission line for transmitting a Tx signal having a format based on the CEDS protocol, in order to perform bidirectional communication between a timing controller and a plurality of source drivers.

In an embodiment, a display device may include: first and second transmission lines used to transmit first and second Tx signals between a timing controller and a source driver; a timing controller configured to transmit the second Tx signal through the second transmission line in an image operation period, and receive correction data through the second transmission line in a correction data transmission period; and a source driver configured to receive the second Tx signal through the second transmission line in the image operation period, and transmit the correction data through the second transmission line in the correction data transmission period.

In another embodiment, a display device may include: first and second transmission lines used to transmit first and second Tx signals between a timing controller and a source driver; a timing controller configured to transmit the first Tx signal to a source driver through the first transmission line in a correction data transmission period, and receive correction data from the source driver through the second transmission line; and the source driver configured to recover a clock signal from the first Tx signal received from the timing controller in the correction data transmission period, and transmit the correction data to the timing controller through the second transmission line in synchronization with the recovered clock signal.

DETAILED DESCRIPTION

Figure 1:
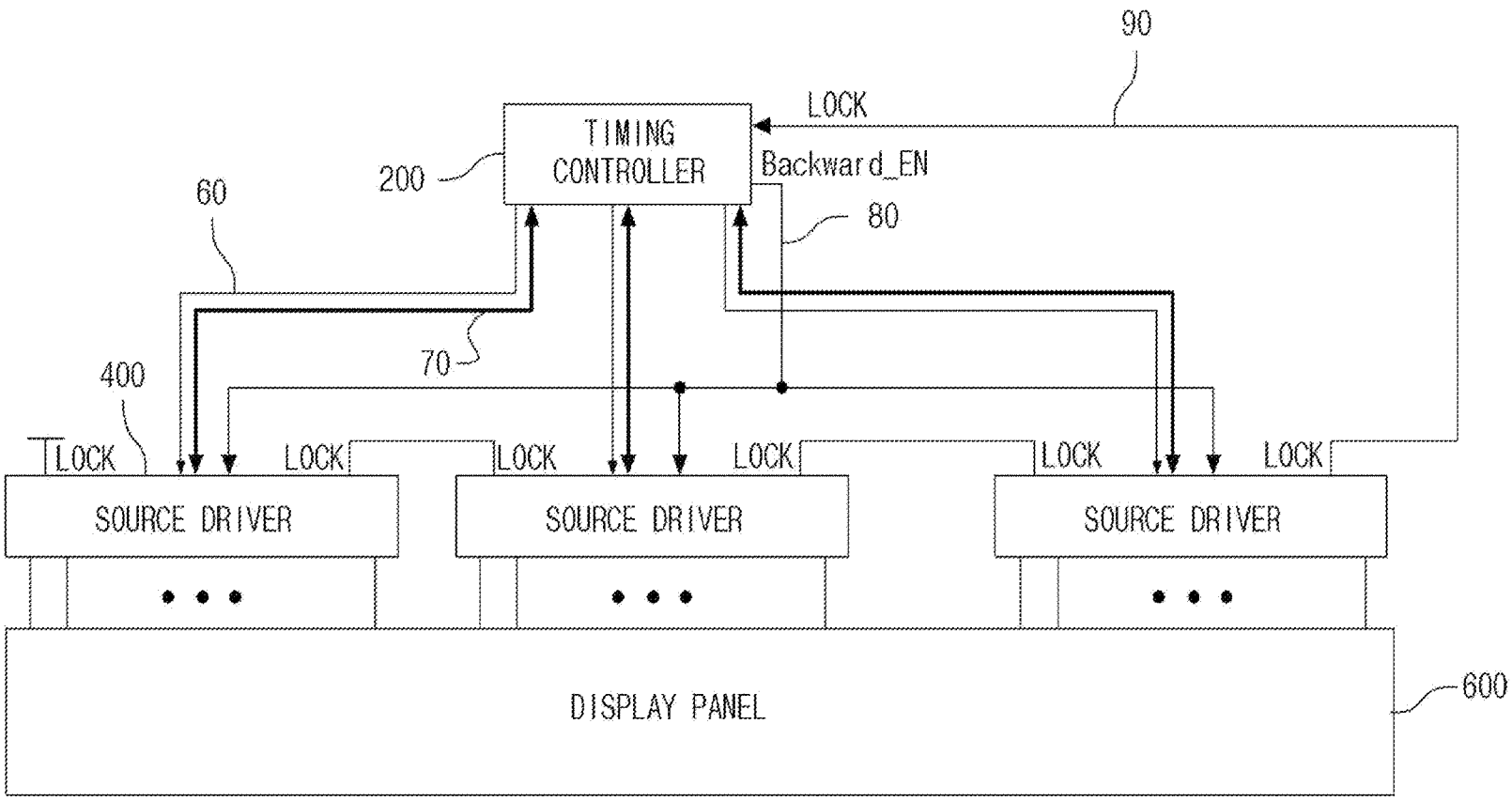
FIG. 1 is a block diagram illustrating a display device in accordance with an embodiment of the present invention.

Hereafter, embodiments of the present invention will be described in detail with reference to the accompanying drawings. The terms used in the present specification and claims are not limited to typical dictionary definitions, but must be interpreted into meanings and concepts which coincide with the technical idea of the present invention.

Embodiments described in the present specification and configurations illustrated in the drawings are preferred embodiments of the present invention, and do not represent the entire technical idea of the present invention. Thus, various equivalents and modifications capable of replacing the embodiments and configurations may be provided at the point of time that the present application is filed.

The embodiments of the present invention disclose a display device that includes a timing controller 200 and a plurality of source drivers 400 which are interfaced through a pair of transmission lines 60 and 70, and performs bidirectional communication through one or more of the transmission lines 60 and 70.

In the present embodiment, CEDS (Clock Embedded Differential Signaling) lines may be used as the transmission lines. The CEDS line may transmit a Tx signal having a format based on the CEDS protocol. According to the CEDS protocol, the Tx signal may have a first format including only a clock signal or a second format including a data signal having a clock signal embedded therein. The data signal may include an image data signal and a control data signal. The image data signal, the control data signal, and the clock signal included in the Tx signal may have the same level and the same amplitude.

In the present embodiment, an operation period for one transmission line (for example, the transmission line 70) may be divided into an image operation period and a correction data transmission period to perform bidirectional communication.

The timing controller 200 may divide the operation period into the image operation period and the correction data transmission period in order to perform bidirectional communication through the transmission line 70. The correction data transmission period may correspond to a part of a vertical blank period, and the image operation period may include the other part of the vertical blank period, an image data transmission period, and a horizontal blank period.

The image operation period refer to a period in which the timing controller 200 transmits a Tx signal having the first or second format to the source driver 400 through the transmission line 70 in response to the vertical blank period, the image data transmission period, or the horizontal blank period.

During the image operation period, the timing controller 200 may transmit the first-format Tx signal through the transmission line 70 when a clock signal is unstable, and transmit the second-format Tx signal through the transmission line 70 when the clock signal is stabilized. The timing controller 200 may transmit the first-format Tx signal through the transmission line 70 in response to the vertical blank period and the horizontal blank period. The correction data transmission period refer to a period in which the source driver 400 transmits correction data to the timing controller 200 through the transmission line 70. That is, the timing controller 200 may not transmit a Tx signal to the source driver 400 through the transmission line 70, and the source driver 400 may transmit correction data to the timing controller 200 through the transmission line 70.

In the present embodiment, the display panel 600 may include an OLED panel, and pixel information sensed from the OLED panel may include the turn-on voltage of an OLED, the threshold voltage Vth of a thin film transistor (TFT), the current characteristic of the TFT, and the mobility characteristic of the TFT.

FIG. 1 is a block diagram illustrating a display device in accordance with an embodiment of the present invention.

Referring to FIG. 1, the display device in accordance with the embodiment of the present invention includes a pair of transmission lines 60 and 70, a timing controller 200, a source driver 400, and a display panel 600. The timing controller 200 and the source driver 400 are configured to transmit/receive a Tx signal and correction data through the pair of transmission lines 60 and 70. For convenience of description, the transmission line 60 is referred to as a first transmission line, and the transmission line 70 is referred to as a second transmission line. The Tx signal transmitted through the first transmission line 60 is referred to as a first Tx signal, and the Tx signal transmitted through the second transmission line 70 is referred to as a second Tx signal.

The timing controller 200 divides an operation period for the second transmission line 70 into an image operation period and a correction data transmission period, in order to perform communication. During the image operation period, the timing controller 200 transmits the first and second Tx signals having the first format or the first and second Tx signals having the second format to the source driver 400 through the first and second transmission lines 60 and 70, respectively, according to a lock signal LOCK. During the correction data transmission period, the timing controller 200 transmits the second-format first Tx signal including only a clock signal to the source driver 400 through the first transmission line 60, and does not transmit the second Tx signal but receives correction data from the source driver 400 through the second transmission line 70. The correction data transmission period may be set to use a part of the vertical blank period.

During the vertical blank period excluding the correction data transmission period, the timing controller 200 transmits the second-format first and second Tx signals including only a clock signal to the source driver 400 through the first and second transmission lines 60 and 70.

In the present embodiment, the case in which three source drivers 400 are provided is taken as an example, for convenience of description. The number of source drivers 400 may be set to various values in consideration of the size of the display panel 600 or the like.

Between the timing controller 200 and the source driver 400, a control line 80 may be formed. The timing controller 200 provides a control signal Backward_En for distinguishing between the image operation period and the correction data transmission period to the source driver 400 through the control line 80.

Between the respective source drivers 400, lock signals may be sequentially transmitted. The last source driver 400 may provide the lock signal LOCK to the timing controller 200 through a lock feedback line 90.

When the deactivated lock signal LOCK is inputted, the timing controller 200 transmits the first-format first and second Tx signals including only a clock signal for clock training (CT) to the source driver 400 through the first and second transmission lines 60 and 70. When the activated lock signal LOCK is inputted, the timing controller 200 transmits the second-format first and second Tx signals including a data signal having a clock signal embedded therein, to the source driver 400 through the first and second transmission lines 60 and 70. The source driver 400 performs clock training when receiving the first-format first and second Tx signals in the image operation period or receiving the first-format first Tx signal in the correction data transmission period. The clock training refers to a process of stabilizing a clock signal by normally synchronizing the clock signal when the clock signal recovered by the source driver 400 is not synchronized but unstable. The clock training may be performed at the vertical blank period, the horizontal blank period, or the point of time at which the clock signal is determined to be abnormal. For example, the source driver 400 internally recovers the clock signal CLK from the first and second Tx signals. The source driver 400 outputs the lock signal LOCK at a low level when the recovered clock signal CLK is unstable, and outputs the lock signal LOCK at a high level when the recovered clock signal CLK is stabilized.

Each of the source drivers 400 outputs the high-level lock signal LOCK to the next source driver 400, when the lock signal LOCK inputted from the immediately previous source driver 400 and the lock signal LOCK generated in the corresponding source driver 400 are high. Furthermore, the source driver 400 recovers a clock signal CLK and an image data signal RGB from the first and second Tx signals, and outputs the image data signal RGB as a source driving signal to the display panel 600 according to the recovered clock signal CLK. The control data signal CTR is recovered together with the image data signal RGB, and involved in an output of the source driving signal. Thus, when all of the source drivers 400 output the lock signal LOCK at a high level, the last source driver 400 supplies the lock signal LOCK at a high level to the timing controller 200.

Figure 2:
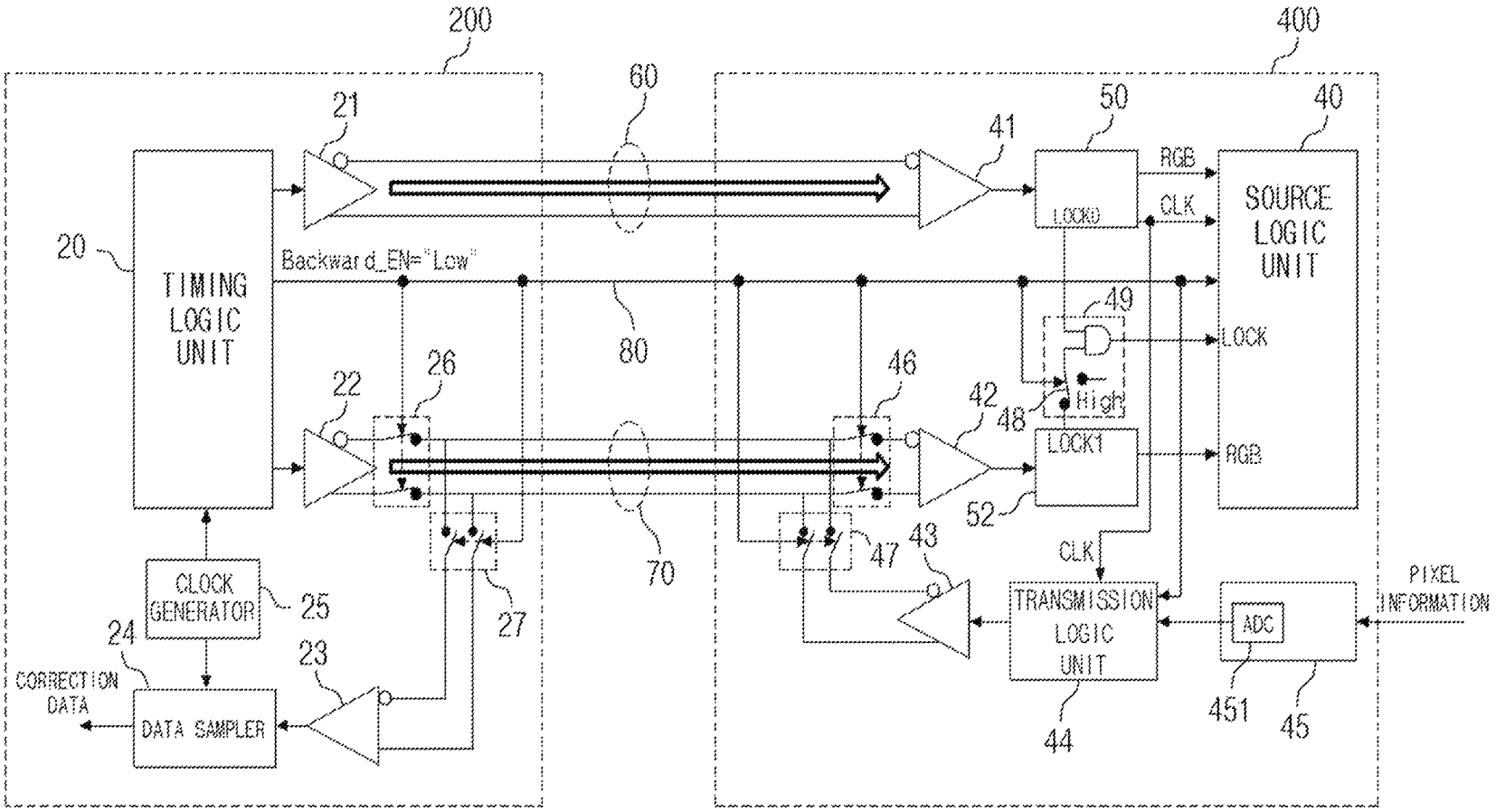
FIG. 2 is a diagram an example of illustrating a timing controller and a source driver of FIG. 1.

FIG. 2 is a diagram an example of illustrating the timing controller 200 and the source driver 400 of FIG. 1.

Referring to FIG. 2, the timing controller 200 includes a first transmitter 21, a second transmitter 22, a receiver 23, a first switch 26, a second switch 27, a timing logic unit 20, a data sampler 24, and a clock generator 25.

The first transmitter 21 converts the first Tx signal provided from the timing logic unit 20 into a format suitable for the CEDS protocol, and outputs the converted signal. The second transmitter 22 converts the second Tx signal provided from the timing logic unit 20 into a format suitable for the CEDS protocol, and outputs the converted signal. The second transmitter 22 transmits the second Tx signal to the source driver 400 in response to a turn-on of the first switch 26 during the image operation period.

The receiver 23 receives correction data in response to a turn-on of the second switch 27 and transmits the correction data to the data sampler 24, during the correction data transmission period.

The first switch 26 transmits the second Tx signal outputted from the second transmitter 22 to the second transmission line 70 in response to the control signal Backward_EN. The first switch 26 is turned on in the image operation period, and turned off in the correction data transmission period.

The second switch 27 transmits the correction data received through the second transmission line 70 to the receiver 23 in response to the control signal Backward_EN. The second switch 27 is turned off in the image operation period, and turned on in the correction data transmission period. That is, the turn-on/off of the first switch 26 is performed in the opposite manner to the turn-on/off of the second switch 27.

The timing logic unit 20 provides the control signal Backward_EN to the first and second switches 26 and 27, and transmits the control signal Backward_EN to the source driver 400 through the control line 80. The timing logic unit 20 provides the first or second-format first and second Tx signal to the first and second transmitters 21 and 22 in response to the state of the lock signal LOCK during the image operation period, and provides the second-format first Tx signal to the first transmitter 21 during the correction data transmission period.

The timing controller 200 may further include the data sampler 24 for sampling the correction data received from the source driver 400 and the clock generator 25 for providing the clock signal to the data sampler 24 and the timing logic unit 20. The timing controller 200 may correct an image using the correction data received from the source driver 400. In the present embodiment, the operation of correcting an image using the correction data is omitted.

Referring to FIG. 2, the source driver 400 includes a first receiver 41, a second receiver 42, a transmitter 43, a third switch 46, a fourth switch 47, a transmission logic unit 44, a first clock-data recovery unit 50, a second clock-data recovery unit 52, a lock signal processing unit 49, a source logic unit 40, and a pixel sensing unit 45.

The first receiver 41 receives the first Tx signal transmitted through the first transmission line 60 from the first transmitter 21 of the timing controller 200 in the image operation period. The second receiver 42 receives the second Tx signal transmitted through the second transmission line 70 and the third switch 46 from the second transmitter 22 of the timing controller 200 in the image operation period.

The transmitter 43 transmits correction data to the receiver 23 of the timing controller 200 through the fourth switch 47 and the second transmission line 70 in the correction data transmission period.

The third switch 46 transmits the second Tx signal transmitted in the image operation period to the second receiver 42 in response to the control signal Backward_EN. The third switch 46 is turned on in the image operation period, and turned off in the correction data transmission period.

The fourth switch 47 transmits the correction data of the transmitter 43 to the second transmission line 70 in response to the control signal Backward_EN, during the correction data transmission period. The fourth switch 47 is turned off in the image operation period, and turned on in the correction data transmission period. That is, the turn-on/off of the third switch 46 is performed in the opposite manner to the turn-on/off of the fourth switch 47.

The transmission logic unit 44 is enabled in response to the control signal Backward_EN, and transmits the correction data provided from the pixel sensing unit 45 to the transmitter 43 in synchronization with the clock signal CLK recovered through the first clock-data recovery unit 50, during the correction data transmission period.

The first clock-data recovery unit 50 recovers a clock signal CLK and an image data signal RGB from the first Tx signal received through the first receiver 41, provides the recovered clock signal CLK and image data signal RGB to the source logic unit 40, and provides the recovered clock signal CLK to the transmission logic unit 44. Furthermore, the first clock-data recovery unit 50 outputs a lock signal LOCK0 at a high level to the lock signal processing unit 49 when the recovered clock signal CLK is stabilized. The second clock-data recovery unit 52 recovers the clock signal CLK and the image data signal RGB from the second Tx signal received through the second receiver 42, and provides the recovered clock signal CLK and image data signal RGB to the source logic unit 40. Furthermore, the second clock-data recovery unit 52 outputs a lock signal LOCK1 at a high level to the lock signal processing unit 49 when the recovered clock signal CLK is stabilized.

The first and second clock-data recovery units 50 and 52 determine whether the clock signal is stabilized, using the recovered clock signal CLK, and outputs the lock signals LOCK0 and LOCK1 corresponding to the determination result to the lock signal processing unit 49. For example, the first and second clock-data recovery units 50 and 52 output the lock signals LOCK0 and LOCK1 at a low level when the recovered clock signal CLK is unstable, and output the lock signals LOCK0 and LOCK1 at a high level when the recovered clock signal CLK is stabilized.

In the image operation period, when the clock signals CLK recovered by the first and second clock-data recovery units 50 and 52 are stabilized to provide the activated lock signals LOCK0 and LOCK1, the lock signal processing unit 49 provides the lock signal LOCK activated at a high level to the source logic unit 40. During the correction data transmission period, when the activated lock signal LOCK0 is provided from the first clock-data recovery unit 50, the lock signal processing unit 49 provides the lock signal LOCK activated at a high level to the source logic unit 40, using a signal which is forced to be activated at a high level in response to the control signal Backward_EN. Since the second clock-data recovery unit 52 does not receive the second Tx signal in the correction data transmission period, the second clock-data recovery unit 52 cannot determine whether the clock signal CLK is stabilized. Thus, during the correction data transmission period, the lock signal processing unit 49 provides the lock signal LOCK to the source logic unit 40, the lock signal LOCK ignoring the state of the lock signal LOCK1 of the second clock-data recovery unit 52 and considering only the lock signal LOCK0 of the first clock-data recovery unit 50.

For example, the lock signal processing unit 49 may include an AND gate and a fifth switch 48. The AND gate compares the lock signal LOCK0 of the first clock-data recovery unit 50 to a signal transmitted from the fifth switch 48, and outputs the lock signal LOCK to the source logic unit 40. The fifth switch 48 transmits the lock signal LOCK1 of the second clock-data recovery unit 52 or the forcibly-activated signal in response to the control signal Backward_EN. For example, the fifth switch 48 transmits the lock signal LOCK1 of the second clock-data recovery unit 52 to one input terminal of the AND gate in the image operation period, and transmits the forcibly-fixed high signal to the one input terminal of the AND gate in the correction data transmission period.

The source logic unit 40 transmits the lock signal LOCK received from the lock signal processing unit 49 to another adjacent source driver. The source logic unit 40 converts the image data signal RGB recovered by the first and second clock-data recovery units 50 and 52 into a source driving signal in synchronization with the clock signal CLK, and outputs the source driving signal to the display panel 600. Although not illustrated in detail, the source logic unit 40 may include a shift register, a latch, and a digital-analog converter (DAC) which are not illustrated in the drawing, in order to process the image data signal RGB in synchronization with the clock signal CLK. The source logic unit 40 outputs a signal processed by the DAC as the source driving signal to the display panel 600 through an output buffer (not illustrated).

The pixel sensing unit 45 senses pixel information from the display panel 600, and provides correction data to the transmission logic unit 44, the correction data being obtained by converting the sensed pixel information into digital data through an analog-digital converter (ADC) 451. The pixel sensing unit 45 may include a plurality of sample and hold (S/H) circuits (not illustrated), an amplifier (not illustrated), and the ADC 451. The plurality of S/H circuits may sense the changes in pixel information of a plurality of pixels formed in the display panel 600, the amplifier may amplify a signal outputted from the S/H circuit, and the ADC 451 may output correction data obtained by converting an output signal of the amplifier into a digital signal. The output signal of the S/H circuit may be converted into a digital signal by the ADC 451, and then provided to the transmission logic unit 44.

Figure 3:
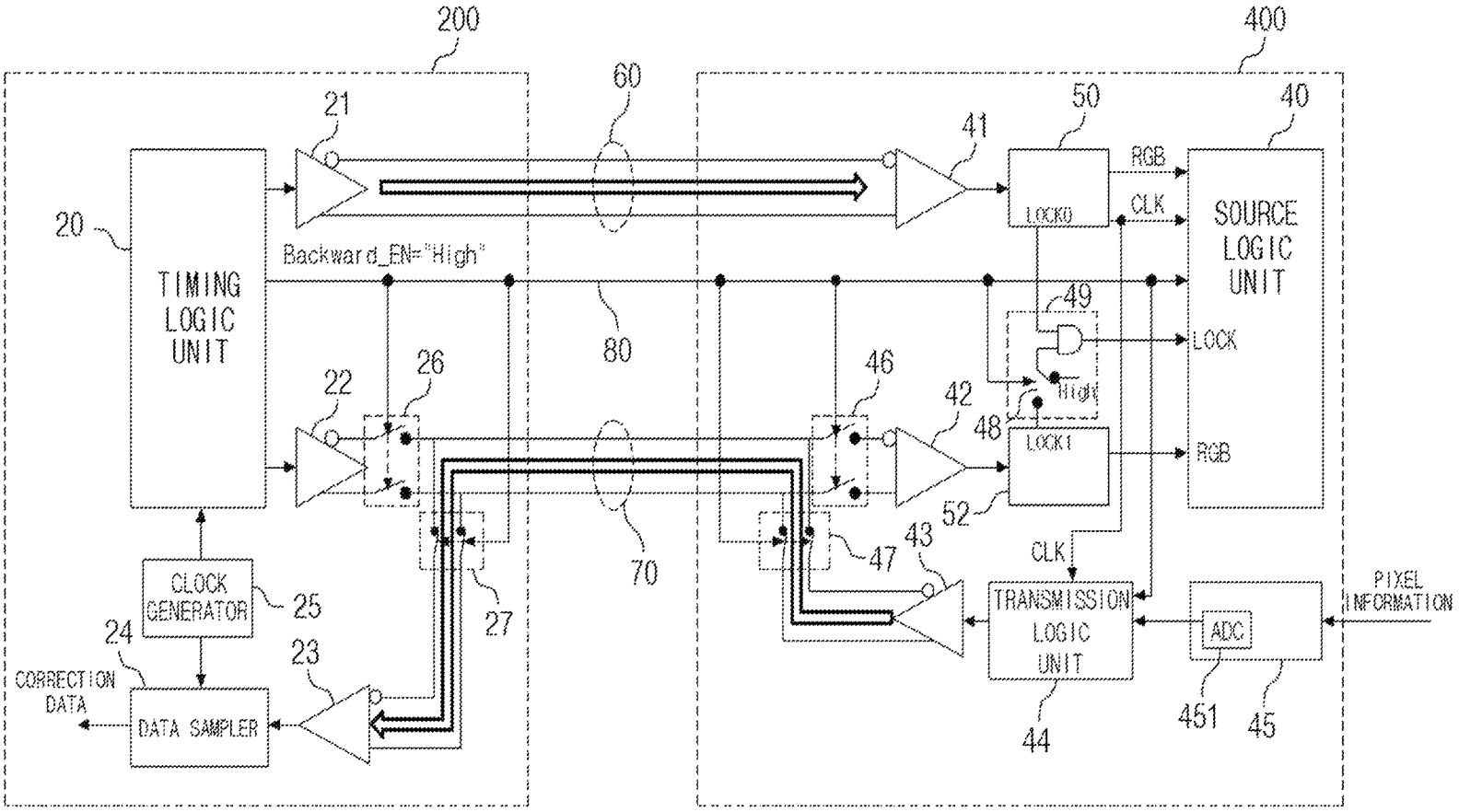
FIG. 3 is a diagram for describing the operation of FIG. 2.
Figure 4:
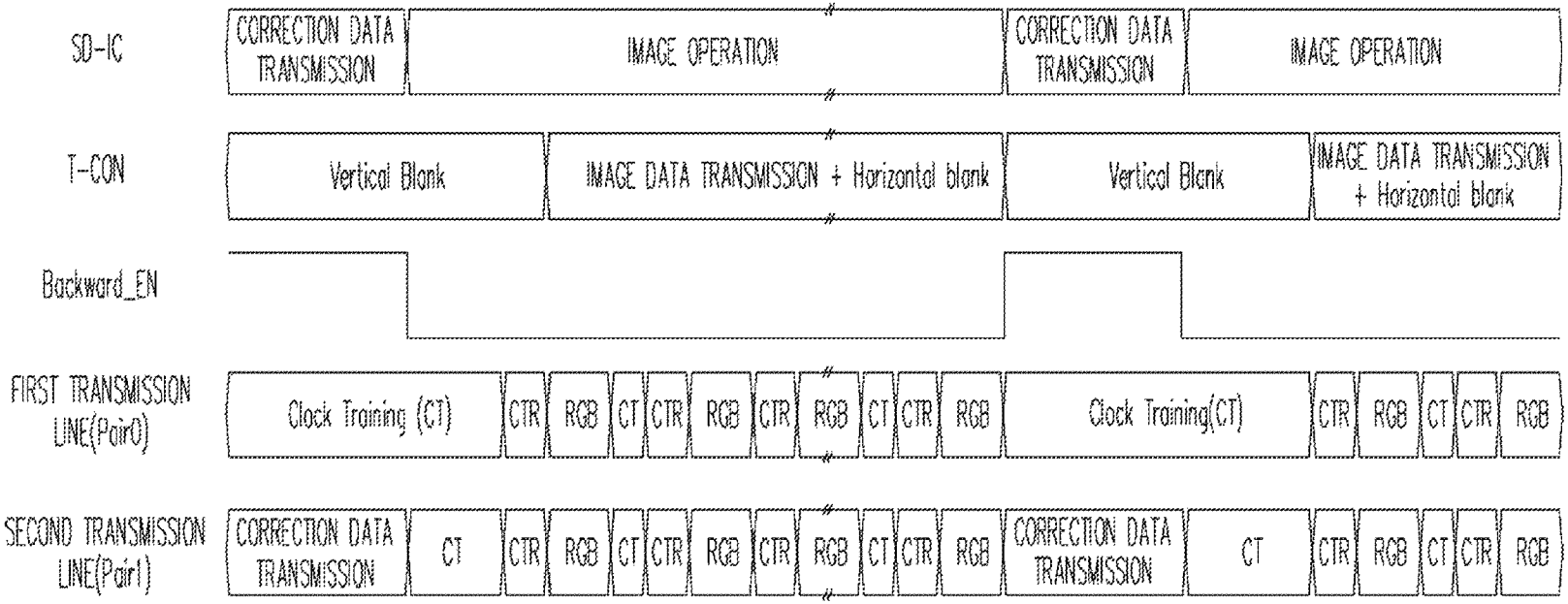
FIG. 4 is a timing diagram of FIG. 2.

FIG. 3 is a diagram for describing the operation of FIG. 2, and FIG. 4 is a timing diagram of FIG. 2. More specifically, FIG. 2 illustrates the operation of the display device in accordance with the present embodiment in the image operation period, FIG. 3 illustrates the operation of the display device in accordance with the present embodiment in the correction data transmission period, and FIG. 4 illustrates timings in the image operation period and the correction data transmission period.

First, the operation of the display device in accordance with the present embodiment in the image operation period will be described as follows.

Referring to FIGS. 2 to 4, the timing controller 200 transmits the first and second Tx signals to the source driver 400 through the first and second transmission lines 60 and 70 in the image operation period.

Specifically, the timing logic unit 20 of the timing controller 200 provides the control signal Backward_EN corresponding to the image operation period to the first and second switches 26 and 27, transmits the first and second Tx signals to the first and second transmitters 21 and 22, and transmits the control signal Backward_EN to the source driver 400 through the control line 80. Then, the first and second transmitters 21 and 22 transmit the first and second Tx signals to the source driver 400 through the first and second transmission lines 60 and 70. At this time, the first switch 26 is turned on in response to the low state of the control signal Backward_EN, and transmits the second Tx signal outputted from the second transmitter 22 to the second transmission line 70. The second switch 27 is turned off in response to the low state of the control signal Backward_EN.

At this time, when the lock signal LOCK is inputted through the lock feedback line 90 from the last source driver 400 among the plurality of source driver 400, the timing controller 200 transmits the first or second-format first and second Tx signals to the source driver 400 through the first and second transmission lines 60 and 70 according to the vertical blank period, the image data transmission period, or the vertical blank period. For example, when the deactivated lock signal LOCK is inputted at a low level, the timing controller 200 transmits the first-format first and second Tx signals to the source driver 400, for clock training. When the activated lock signal LOCK is inputted at a high level, the timing controller 200 transmits the second-format first and second Tx signals to the source driver 400.

The source driver 400 receives the first and second Tx signals through the first and second transmission lines 60 and from the timing controller 200, and receives the control signal Backward_EN through the control line 80.

The source driver 400 recovers the clock signal CLK and the image data signal RGB from the first and second Tx signals, processes the image data signal RGB into the source driving signal in response to the recovered clock signal CLK, and outputs the source driving signal to the display panel 600.

The first and second receivers 41 and 42 of the source driver 400 receive the first and second Tx signals through the first and second transmission lines 60 and 80 from the first and second transmitters 21 and 22 of the timing controller 200, and provide the received signals to the first and second clock-data recovery units 50 and 52. At this time, the third switch 46 is turned on in response to the low state of the control signal Backward_EN and transmits the second Tx signal to the second receiver 42, and the fourth switch 47 is turned off in response to the low state of the control signal Backward_EN.

The first clock-data recovery unit 50 recovers a clock signal CLK and an image data signal RGB from the second Tx signal received through the first receiver 41, and provides the recovered clock signal CLK and image data signal RGB to the source logic unit 40. Furthermore, the first clock-data recovery unit 50 provides the recovered clock signal CLK to the transmission logic unit 44, and outputs the lock signal LOCK0 at a high level to the lock signal processing unit 49 when the recovered clock signal CLK is stabilized.

The second clock-data recovery unit 52 recovers a clock signal CLK and an image data signal RGB from the second Tx signal received through the second receiver 42, and provides the recovered image data signal RGB to the source logic unit 40. The second clock-data recovery unit 52 outputs the lock signal LOCK1 at a high level to the lock signal processing unit 49 when the recovered clock signal CLK is stabilized.

When the lock signals LOCK0 and LOCK1 activated to a high level are outputted from the first and second clock-data recovery units 50 and 52, the lock signal processing unit 49 activates the lock signal LOCK to a high level and provides the lock signal LOCK to the source logic unit 40.

The source logic unit 40 transmits the lock signal LOCK received from the lock signal processing unit 49 to another adjacent source driver. The source logic unit 40 outputs the source driving signal for driving the display panel 600 in response to the vertical blank period, the image data transmission period, and the horizontal blank period.

Next, the operation of the display device in accordance with the present embodiment in the correction data transmission period will be described as follows.

Referring to FIG. 3, the first transmitter 21 of the timing controller 200 transmits the first-format first Tx signal including only the clock signal to the source driver 400 through the first transmission line 60 in the correction data transmission period. Unlike the first transmitter 21, the second transmitter 22 cannot transmit the first-format second Tx signal to the source driver 400, because the first switch 26 is turned off in response to the high state of the control signal Backward_EN. At this time, the third switch 46 connected to the second receiver 42 of the source driver 400 is also turned off in response to the high state of the control signal Backward_EN.

The first clock-data recovery unit 50 normally performs the operation of recovering the first Tx signal received through the first receiver 41.

In response to the high state of the control signal Backward_EN in the correction data transmission period, the second and fourth switches 27 and 47 are turned on, and the fifth switch 48 transmits a forcibly-fixed high value to one input terminal of the AND gate.

Thus, the lock signal processing unit 49 provides the lock signal LOCK following the state of the lock signal LOCK0 of the first clock-data recovery unit 50 to the source logic unit 40 in response to the control signal Backward_EN. Therefore, in the correction data transmission period, the lock signal processing unit 49 may not be affected by the lock signal LOCK1 of the second clock-data recovery unit 52, but activate the lock signal LOCK to a high level.

The source logic unit 40 transmits the lock signal LOCK received from the lock signal processing unit 49 to another adjacent source driver.

The pixel sensing unit 45 senses pixel information from the display panel 600, and provides correction data, obtained by converting the sensed pixel information into digital data through the ADC 451, to the transmission logic unit 44.

The transmission logic unit 44 is enabled in response to the high state of the control signal Backward_EN, and transmits the correction data of the pixel sensing unit 45 to the transmitter 43 in synchronization with the clock signal CLK recovered through the first clock-data recovery unit 50.

The transmitter 43 transmits the correction data provided from the transmission logic unit 44 to the receiver 23 of the timing controller 200 through the turned-on fourth switch 47 and the second transmission line 70.

Then, the timing controller 200 performs image correction in response to the correction data received from the source driver 400 through the turned-on second switch 27. The detailed descriptions of the image correction process using the correction data are omitted herein.

Figure 5:
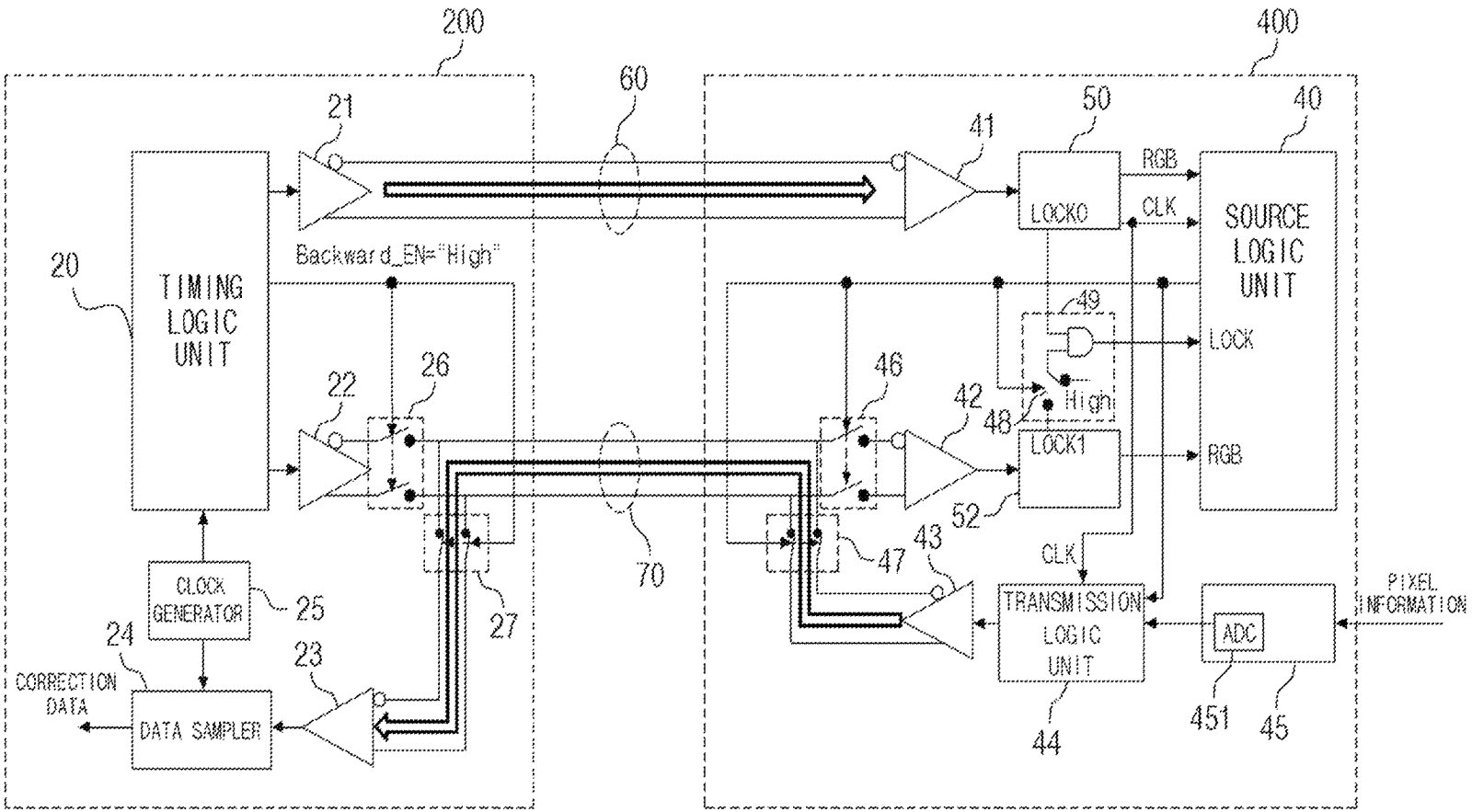
FIG. 5 is a diagram illustrating another example of the timing controller and the source driver of FIG. 1.
Figure 6:
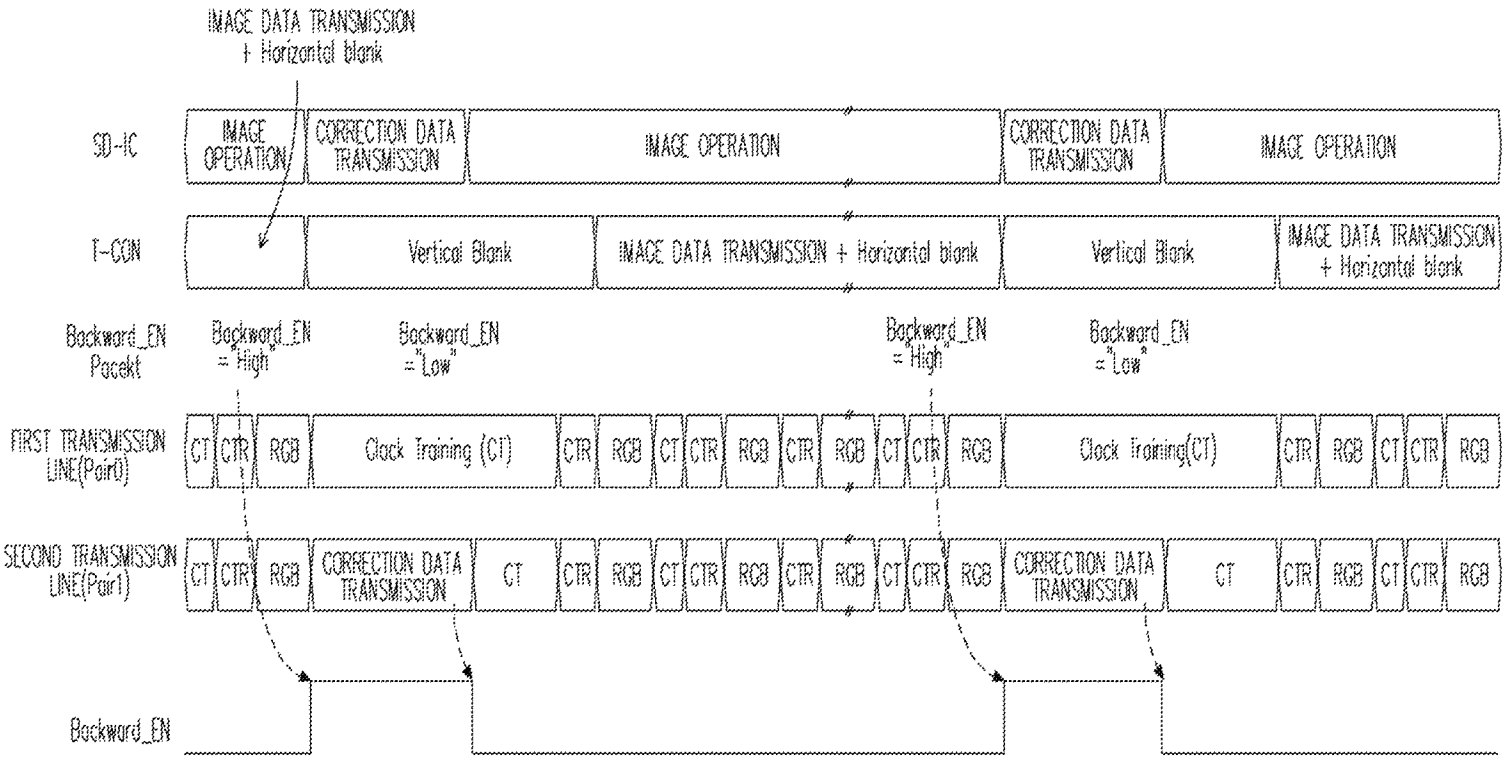
FIG. 6 is a timing diagram of FIG. 5.

FIG. 5 is a diagram illustrating another example of the timing controller and the source driver of FIG. 1, and FIG. 6 is a timing diagram of FIG. 5.

Referring to FIGS. 5 and 6, the display device in accordance with the embodiment of the present invention includes first and second transmission lines 60 and 70, a timing controller 200, and a source driver 400. The first and second transmission lines 60 and 70 are used as media for bidirectional communication between the timing controller 200 and the source driver 400.

The timing controller 200 generates a control signal Backward_EN for distinguishing between the image operation period and the correction data transmission period, transmits first and second Tx signals to the source driver 400 in the image operation period, includes the control signal Backward_EN in the last packet of a data signal, and transmits the data signal to the source driver 400. The data signal may include one or more of a control data signal CTR and an image data signal RGB.

The source driver 400 recovers the control signal Backward_EN included in the data signal of the first Tx signal through the first clock-data recovery unit 50, and provides the recovered signal to the source logic unit 40. The source logic unit 40 of the source driver 400 provides the control signal Backward_EN to the third, fourth, and fifth switches 46, 47, and 48 and the transmission logic unit 44.

The timing controller 200 and the source driver 400 uses a part of the vertical blank period as the correction data transmission period when the control signal Backward_En is activated, and resets the control signal Backward_EN when all of the correction data are transmitted and received. When the control signal Backward_EN is reset, the timing controller 200 transmits the first-format second Tx signal for clock training to the source driver 400, and the source driver 400 recovers the clock signal from the first-format second Tx signal, and activates the lock signal LOCK when the recovered clock signal is stabilized.

The last source driver 400 provides the activated lock signal LOCK to the timing controller 200, and the timing controller 200 transmits the second-format first and second Tx signals to the source driver 400 in response to the activated lock signal LOCK.

For example, as illustrated in FIG. 6, the timing controller 200 may include the control signal Backward_EN in the last data signal (control data signal or image data signal) of the image operation period, and then transmit the data signal. When the control signal Backward_EN is high, the timing controller 200 and the source driver 400 perform the operation corresponding to the correction data transmission period.

Since the operation of the embodiment based on the configuration of FIGS. 5 and 6 is performed in the same manner as the operation of FIG. 2, the duplicated descriptions are omitted herein. The embodiment of FIGS. 5 and 6 has an advantage in that a control line for transmitting the control signal can be omitted.

In accordance with the embodiments of the present invention, the display device can perform bidirectional communication between the timing controller and the plurality of source drivers, and various pieces of information such as correction data corresponding to pixel information to the timing controller.

Furthermore, the plurality of source drivers can transmit the correction data to the timing controller using the transmission lines for transmitting Tx signals based on the CEDS protocol, thereby avoiding impedance mismatching which may occur when a separate shared bus line is used. Furthermore, the display device does not need to secure a transmission period for each of the source drivers, and can reliably transmit the correction data to the timing controller even at a low transmission rate.

While various embodiments have been described above, it will be understood to those skilled in the art that the embodiments described are by way of example only. Accordingly, the disclosure described herein should not be limited based on the described embodiments.

What is claimed is:

1. A display device comprising:

first and second transmission lines used to transmit first and second Tx signals between a timing controller and a source driver;

a timing controller configured to transmit the first and second Tx signals through the first and second transmission lines to the source driver in an image operation period, transmit the first Tx signal to the source driver through the first transmission line in a correction data transmission period, and receive correction data from the source driver through the second transmission line in the correction data transmission period; and the source driver configured to receive the first and second Tx signals through the first and second transmission lines in the image operation period, recover a clock signal from the first Tx signal received from the timing controller in the correction data transmission period, and transmit the correction data to the timing controller through the second transmission line in synchronization with the recovered clock signal in the correction data transmission period.

2. The display device of claim 1, wherein the timing controller comprises:

a first transmitter configured to transmit the first Tx signal through the first transmission line;

a second transmitter configured to transmit the second Tx signal through the second transmission line;

a first switch configured to connect the second transmitter and the second transmission line in response to the image operation period;

a receiver configured to receive the correction data through the second transmission line; and a second switch configured to connect the second transmission line and the receiver in response to the correction data transmission period, wherein the first and second switches are turned on and off in an opposite manner to each other in response to the image operation period and the correction data transmission period.

3. The display device of claim 1, wherein the source driver comprises:

a first receiver configured to receive the first Tx signal through the first transmission line;

a second receiver configured to receive the second Tx signal through the second transmission line;

a third switch configured to connect the second transmission line and the second receiver in response to the image operation period;

a transmitter configured to transmit the correction data through the second transmission line;

a fourth switch configured to connect the second transmission line and the transmitter in response to the correction data transmission period, wherein the transmitter transmits the correction data corresponding to pixel information through the second transmission line in the correction data transmission period.

4. The display device of claim 3, wherein the source driver further comprises:

a first clock-data recovery circuit configured to recover a clock signal and an image data signal from the first Tx signal received through the first receiver;

a second clock-data recovery circuit configured to recover the clock signal and the image data signal from the second Tx signal received through the second receiver; and a lock signal processing circuit configured to output a lock signal by comparing lock states of the first and second clock-data recovery circuits in the image operation period, and output the lock signal by comparing an internal lock signal of the first clock-data recovery circuit to a signal having a fixed value in the correction data transmission period.

5. The display device of claim 1, wherein the display panel comprises an OLED panel.

6. The display device of claim 1, wherein the timing controller generates a control signal for distinguishing between the image operation period and the correction data transmission period, and transmits the control signal to the source driver.

7. The display device of claim 6, wherein the timing controller provides the control signal to the source driver through a control line which is configured separately from the first and second transmission lines.

8. The display device of claim 6, wherein the timing controller includes the control signal in the first Tx signal and provides the control signal to the source driver.

9. The display device of claim 8, wherein the control signal is included in a control data signal or image data signal of the first Tx signal.

10. A display device comprising:

first and second transmission lines used to transmit first and second Tx signals between a timing controller and a source driver;

a timing controller configured to transmit the first Tx signal to the source driver through the first transmission line in a correction data transmission period, and receive correction data from the source driver through the second transmission line; and the source driver configured to recover a clock signal from the first Tx signal received from the timing controller in the correction data transmission period, and transmit the correction data to the timing controller through the second transmission line in synchronization with the recovered clock signal.

11. The display device of claim 10, wherein the timing controller transmits the first and second Tx signals to the source driver through the first and second transmission lines in the image operation period, generates a control signal for distinguishing between the image operation period and the correction data transmission period, and includes the control signal into the last packet of the data signal to transmit to the source driver.

12. The display device of claim 11, wherein the source driver transmits the correction data to the timing controller in response to the control signal in the correction data transmission period.

13. The display device of claim 12, wherein the timing controller and the source driver are set to use a part of a vertical blank period as the correction data transmission period, when the control signal is activated.

14. The display device of claim 13, wherein the timing controller and the source driver reset the control signal when all of the correction data are transmitted and received.

15. The display device of claim 14, wherein the timing controller transmits the second Tx signal for clock training to the source driver through the second transmission line, when the control signal is reset.

16. The display device of claim 10, wherein the source driver trains the clock signal, and transmits the correction data when the clock signal is locked.

* * * * *